US005902408A

United States Patent [19]

Player et al.

[11] Patent Number: 5,902,408

[45] Date of Patent: May 11, 1999

[54] PROCESS FOR REFINING RAW SUGAR

[75] Inventors: Murray Richard Player, Epping; Peter James Field, Westleigh, both of Australia

[73] Assignee: CSR Limited, New South Wales, Australia

[21] Appl. No.: 08/894,769

[22] PCT Filed: Feb. 15, 1996

[86] PCT No.: PCT/AU96/00079

§ 371 Date: Dec. 8, 1997

§ 102(e) Date: Dec. 8, 1997

[87] PCT Pub. No.: WO96/25522

PCT Pub. Date: Aug. 22, 1996

[30] Foreign Application Priority Data

Feb. 16, 1995 [AU] Australia ..... PN1180

[51] Int. Cl.[6] ..... C13F 3/00

[52] U.S. Cl. ..... 127/30; 127/50; 127/55; 127/58

[58] Field of Search ..... 127/30, 50, 55, 127/58

[56] References Cited

PUBLICATIONS

Perry et al, Chemical Engineer's Handbook, 1973.

*Primary Examiner*—David Brunsman
*Attorney, Agent, or Firm*—Jones & Askew, LLP

[57] ABSTRACT

The present invention is related to a process for refining raw sugar comprising the steps of: (a) dissolving either washed raw sugar or raw sugar directly to produce a melter liquor; (b) clarifying the melter liquor; (c) crystallising the melter liquor to produce a mixture of a very low colour intermediate sugar and a syrup; (d) separating the very low colour intermediate sugar from the syrup; (e) redissolving the separated very low colour intermediate sugar to produce a fine liquor; (f) filtering the fine liquor to remove any foreign particles which may have contaminated the sugar produced in step (d); and (g) crystallising refined sugar from the fine liquor. The invention is also related to a process for producing very low colour (VLC) intermediate sugar by the steps of (a) to (d) defined above.

9 Claims, 3 Drawing Sheets

PROCESS FOR REFINING RAW SUGAR

TECHNICAL FIELD

The present invention relates to a method for milling sugar cane to produce raw sugar and to refining raw sugar to produce refined white sugar.

BACKGROUND ART

Raw sugar is produced by milling sugar cane and is, of necessity, done in close proximity to the fields in which the sugar cane is grown. The raw sugar includes soluble and insoluble impurities which are normally removed by a process called refining which is usually carried out in a sugar refinery. Conventional sugar refining processes are normally, though not necessarily, carried out close to consumer markets and often at great distances from the sugar mill in which the raw sugar was produced. The process conventionally used for sugar refining involves dissolution of the washed raw sugar to produce a melter liquor. The melter liquor is then limed and subjected to a process of carbonatation or phosphatation in which calcium carbonate or calcium phosphate, respectively, is caused to be precipitated and the precipitate is filtered from the liquor in the case of carbonatation and skimmed from the liquor after aeration in the case of phosphatation. Substantially all of the suspended particulate material in the melter liquor is removed with the precipitate during filtration. This procedure, which is generally referred to as clarification, results in a straw coloured clear liquor.

The clear liquor is subjected to decolorisation, typically by being passed through a column containing an adsorbent material such as bone charcoal, resins or granular carbon. The decolorisation process results in a fine liquor from which white sugar is crystallised in vacuum pans. The resulting suspension of crystals in syrup is separated in centrifugals and the sugar is then dried to produce free flowing white crystal sugar.

Australian Patent Specification 84859/91 describes an alternative process for refining cane raw sugar. In this process raw sugar is dissolved to produce a melter liquor and then boiled to crystallise the sugar in the melter liquor. This sugar is recovered as a very low colour intermediate sugar (VLC sugar). If redissolved and filtered the VLC sugar yields a clear fine liquor. When boiled this fine liquor produces white sugar crystals of a colour equivalent to the white refined sugar produced in a conventional sugar refinery employing a traditional decolorising system such as char, granulated carbon or an ion exchange resin.

White sugar should have a turbidity value of approximately 5 or less to be satisfactory in commercial markets. Experience with a variety of raw sugars has shown that the process described in Australian Patent Specification 84859/91 could not consistently meet this specification.

DISCLOSURE OF THE INVENTION

The present invention consists in a process for refining raw sugar comprising the steps of:

(a) dissolving either washed raw sugar or raw sugar directly to produce a melter liquor;

(b) clarifying the melter liquor;

(c) crystallising the melter liquor to produce a mixture of a very low colour intermediate sugar and a syrup;

(d) separating the very low colour intermediate sugar from the syrup;

(e) redissolving the separated very low colour intermediate sugar to produce a fine liquor;

(f) filtering the fine liquor to remove any foreign particles which may have contaminated the sugar produced in step (d): and (g) crystallizing refined sugar from the fine liquor.

The invention further consists in refined sugar produced by the process according to the present invention. In another aspect, the present invention consists in a process for producing a very low colour (VLC) intermediate sugar by the steps (a) to (d) defined above and to the very low colour (VLC) immediate sugar produced thereby.

In a further aspect, the present invention consists in a process for producing a refined sugar by refining a very low colour (VLC) intermediate sugar using the steps (e) to (g) defined above and to the refined sugar produced thereby.

The step of clarifying the melter liquor is preferably achieved by phosphatation or carbonatation.

The process of phosphatation involves reacting in the sugar solution lime and phosphoric acid. The precipitate formed is removed by aerating the solution and skimming the particulate material from the surface of the solution. The process of carbonatation involves reacting in the sugar solution lime and carbon dioxide. The precipitate is removed from the solution by filtration. These processes are more fully described in "Cane Sugar Handbook" edited by J. C. P. Chen.

It has been surprisingly found that by subjecting the melter liquor to a clarification step prior to crystallisation of the very low colour (VLC) intermediate sugar there is removed from the liquor most of the soluble substances or materials that cause the turbidity of the final sugar product. The steps of phosphatation and carbonatation are well known in conventional sugar refining and are principally used to remove particulate matter by entrapment in a precipitate generated within the sugar solution being treated. It could not have been predicted that a clarification process carried out at this early stage in the refining process would be effective in reducing the dissolved substance causing the residual turbidity in the final product.

Traditionally, sugar refining has been carried out close to the place of sugar consumption because the cost of transporting a food grade product is more expensive than transporting raw sugar which can be carried in bulk without the hygiene constraints attached to handling white sugar. Sugar refining, however, is capital intensive and compared with sugar milling has high energy costs and high waste disposal costs. Because energy for sugar milling is derived from bagasse, the fibrous residue of sugar cane, it is a fuel that is virtually free and would otherwise be a waste product which would be difficult to dispose of. Since sugar mills are located close to the cane farms supplying them, disposal of phosphatation waste as fertiliser for cane growing is much less expensive than the disposal of this waste in a city environment.

The refining process considered in Australian Patent Specification 84859/91 envisaged the whole process being conducted in a sugar mill. This is still possible for this improved process. However, a more attractive option is to manufacture the VLC sugar in a sugar mill and transport this sugar to a refinery located at or near the place of sugar consumption.

The sugar refinery would then complete the process involving filtration and crystallising white sugar. The dissolved VLC sugar after filtration and concentration adjustment could be sold as liquid sugar to those customers who traditionally buy fine liquor.

A sugar refinery using this VLC feedstock would be a low capital, low operating cost factory compared with a conventional refinery. The stations eliminated include clarification by either carbonatation or phosphatation, decolorisation by activated carbon, char or ion exchange resin, boil-out station, waste disposal from clarification and decolorisation.

It is particularly preferred that the clarification step is carried out by phosphatation because this is the most cost effective in terms of capital equipment employed and chemicals consumed. It has the additional advantage that the residue from phosphatation may be usefully used as a fertiliser in sugar cane fields when the process is carried out at a sugar mill close to the fields. In contrast if the process were carried out at a city located refinery there would be substantial costs in disposing of the waste in the municipal sewer system. Carbonatation may also be used as the clarification step as it has also been found to adsorb the dissolved material which contributes to the turbidity in the refined sugar. The carrying out of the clarification step prior to the crystallisation of the VLC sugar also has the advantage that it has less colour development on storage.

Colourants in sugar give rise to colour development on storage. The carrying out of the clarification before crystallisation of the VLC sugar will give a lower colour VLC sugar which will be subject to less colour development on storage.

The VLC sugar produced by the process according to this invention may be used for direct consumption where a product of mill white specification is called for. In this case the product will be better than conventional mill white sugars as it has less colour and lower turbidity.

BRIEF DESCRIPTION OF THE DRAWINGS

Preferred embodiments of the present invention are hereinafter described with reference to the accompanying drawings in which.

BEST MODE FOR CARRYING OUT THE INVENTION

Figure 1:
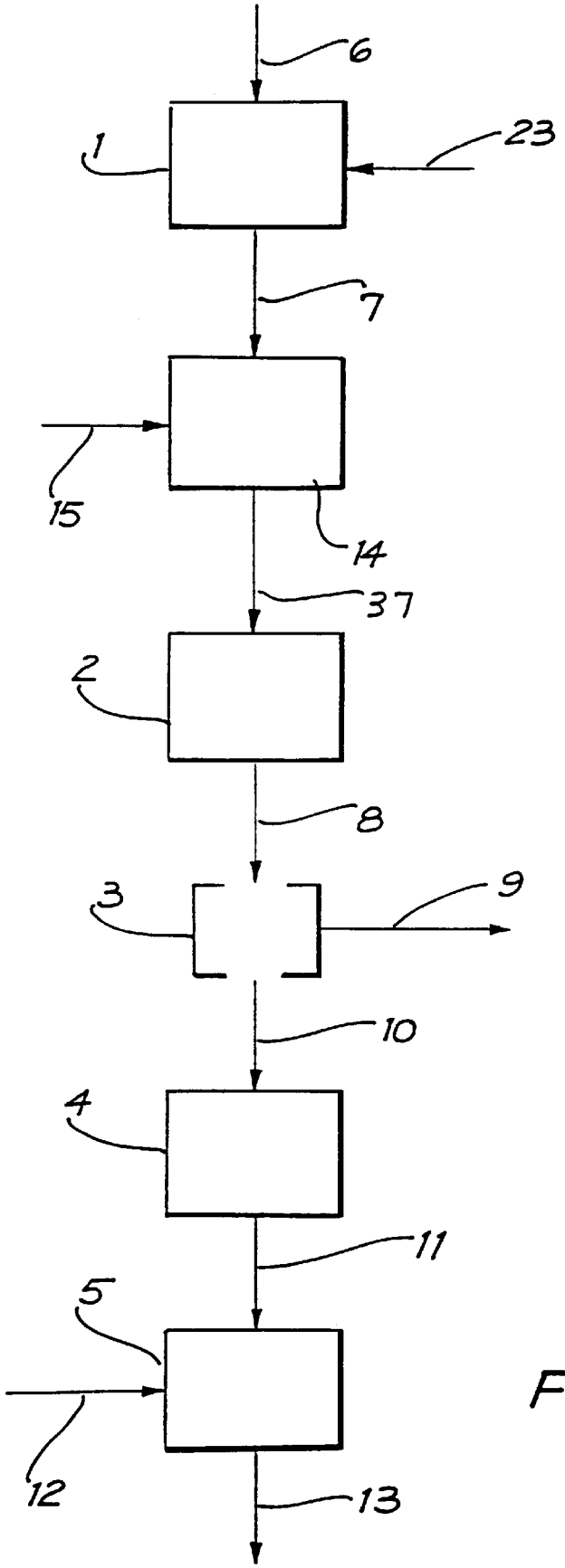
FIG. 1 is a block diagram showing a simplified application of the process according to the present invention.

The basic features of the present invention are shown in the simplified application of the invention described with reference to FIG. 1. In this arrangement raw sugar 6 is dissolved in water 23, or another aqueous liquid such as sweet water derived from another sugar processing step, in a melter 1 to produce melter liquor 7.

The melter liquor 7 is subjected to carbonatation or phosphatation in reactor 14. Lime and carbon dioxide, or lime, phosphoric acid and a flocculant, are also added to the reactor 14 as depicted by line 15. The resultant precipitate is removed by filtration or flotation as the case may be. The clarified melter liquor 37 is crystallized in a vacuum pan 2 to produce a mixture 8 of crystallized sugar and syrup. The crystals 10 are separated from the syrup 9 in a separating device 3 such as a centrifugal.

The separated crystalline sugar 10 is redissolved in water, or another aqueous liquid in a further melter 4 to produce fine liquor 11 which may contain foreign particles which can be removed by filtration. A small amount of a filter aid 12 is added to the fine liquor 11 and, if desired, powdered carbon and/or powdered ion exchange resin may also be added, then the fine liquor 11 is filtered in a filter 5 to produce a fine liquor 13 from which refined sugar may be crystallized in conventional crystallization steps.

Figure 2:
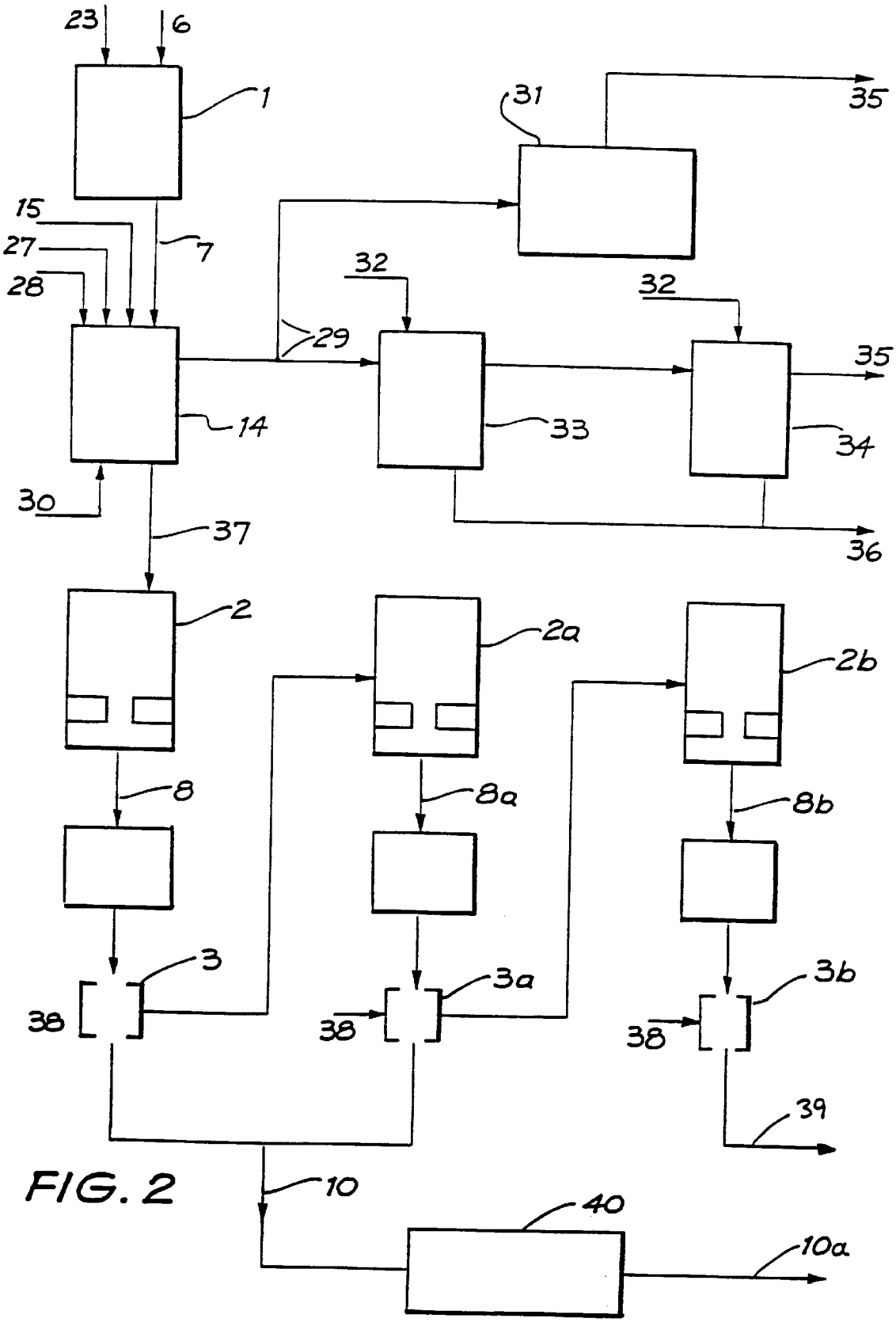
FIGS. 2 and 3 are block diagrams showing a more detailed application of the process according to the present invention.
Figure 3:
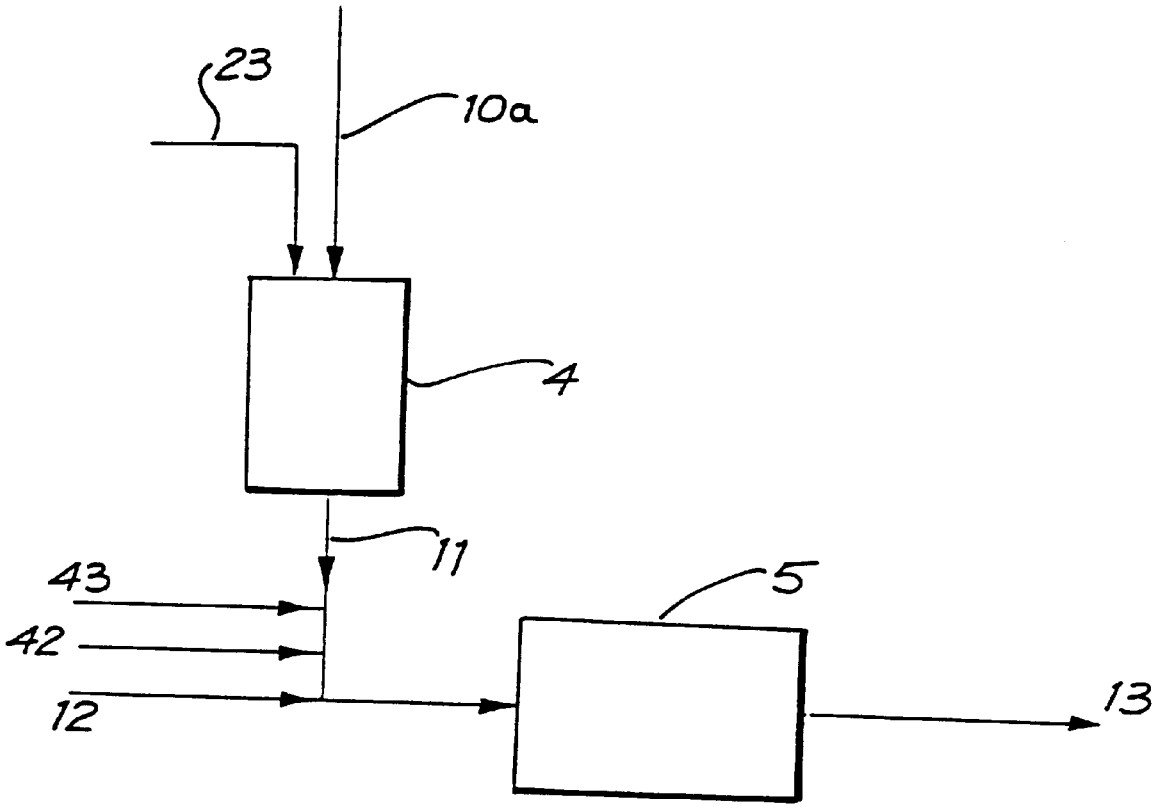

A more detailed application of the process according to the present invention is described in FIGS. 2 and 3, where the same reference numerals are used for like features.

The raw sugar 6 used in the process depicted in FIGS. 2 and 3 preferably has a polarisation in excess of 99.20° Z and will be dissolved in a melter 1 using water or sweetwater 23 to a concentration of approximately 67° Bx at around 80° C. The melter liquor 7 produced from this step is then clarified in a reactor 14 using the processes of phosphatation or carbonatation. Since phosphatation is the most cost effective process, this is the preferred method of clarification. Lime 15, phosphoric acid 27 and a polyelectrolyte flocculant 28 are added to the reactor 14 being fed with melter liquor 7. The calcium phosphate scums 29 with the entrained impurities from the melter liquor 7 are removed at the top of the reactor 14 by flotation through the introduction of fine air bubbles 30 at the bottom of the reactor 14. The phosphatation scums 29 are desweetened during the sugar mill's crushing season by including the scums 29 in the primary need feed of the mill's rotary vacuum filter 31. When the mill is not running, phosphatation scums 29 are conveniently desweetened by mixing them with water 32 and refloating the precipitated material in two reactors 33 and 34 before disposal as phosphate rich material 35 which can be used as a fertiliser. The sweetwater 36 produced in this washing process can be re-used for dissolving raw sugar in the melter 1.

The clarified melter liquor 37 is boiled in three strikes in vacuum pans 2, 2*a* and 2*b* to produce a suspension of crystals and syrups 8, 8*a* and 8*b* which are each respectively separated in centrifugals 3, 3*a* and 3*b* using a small quantity of wash water 38 to produce sugar of the desired quality. The sugar from the first and second strikes is used as very low colour intermediate sugar 10 while that from the third strike 39 is used to provide seed for raw sugar strikes in the sugar mill. The use of third strike very low colour intermediate sugar as seed improves the quality of raw sugar compared with the conventional use of third strike, C crystals, which are remelted and sent to the mill's syrup tank.

The wet very low colour intermediate sugar 10 is dried in a sugar drier 40 to a moisture content less than 0.1%, preferably about 0.08%, and is ready for transportation to the refinery.

Following transportation to a sugar refinery, the very low colour intermediate sugar 10*a* is dissolved using water or sweetwater 23 in a melter 4 (See FIG. 3) to produce a fine liquor 11 which is then filtered in a filter 5 using a diatomaceous earth filter aid 12 (see FIG. 3). If the colour of the fine liquor needs further reduction then powdered carbon 42 or powdered ion exchange resin 43 may be added to the fine liquor before feeding it through a filter 5. The filtered fine liquor 13 is then used as liquid sugar or as a feedstock for boiling white sugar in vacuum pans in a conventional manner.

In order to illustrate the advantages of the invention described above experiments have been undertaken. Initially, raw sugar was dissolved in water to produce melter liquor. This was then processed in a first known process, in a second process according to the present invention and in a third known alternative process.

In the first case the melter liquor was boiled in a vacuum pan to produce a suspension of crystals and syrup which was then separated in a centrifugal using a small quantity of wash water to produce sugar of a quality suitable for dissolution to fine liquor. Cloudy fine liquor was produced by dissolving this sugar in water. A small quantity of diatomaceous earth was added to the cloudy fine liquor. After using a small quantity of this suspension to precoat the pressure filter, the cloudy fine liquor was filtered to produce fine liquor. This fine liquor was crystallized in a vacuum pan in a manner similar to that normally employed in a sugar refinery for boiling white sugar.

In the second case, a portion of the melter liquor prepared above was clarified using a phosphatation process comprising the addition of phosphoric acid, milk of lime, and a polyelectrolyte. The precipitated scum was removed by aeration and the resulting clarified melter liquor was boiled in a vacuum pan to produce a suspension of crystals and syrup similar to that described above. After centrifugation this sugar was dissolved and filtered with diatomaceous earth to give fine liquor from which white sugar was boiled.

In the third case, a portion of the melter liquor prepared in the first case was boiled in a vacuum pan to crystallise the sugar in the melter liquor. The resulting very low colour (VLC) intermediate sugar was recovered. redissolved, clarified using a phosphatation process and filtered to yield a clear fine liquor. The clear fine liquor was then boiled to produce white sugar.

The colour and turbidity of the principal products of the three processes described above were measured and are shown in Table 1.

TABLE 1

Colour and turbidity of products of refining using the three processes defined in the specification.

| PROCESS | Process 1 | | Process 2 | | Process 3 | |
|---|---|---|---|---|---|---|
| STEPS | Colour | Turbidity | Colour | Turbidity | Colour | Turbidity |
| Melter Liquor | 1440 | 213 | 1440 | 213 | 1440 | 213 |
| Phosphated Melter Liquor | N/A | N/A | 1421 | 30 | N/A | N/A |
| VLC sugar | 201 | 42 | 169 | 15 | 201 | 42 |
| Phosphated VLC Liquor | N/A | N/A | N/A | N/A | 113 | 3 |
| Celite Filtered Liquor | 186 | 12 | 164 | 6 | 110 | 3 |
| White sugar | 24 | 6 | 17 | 5 | 13 | 9 |

In comparison to process 1, processes 2 and 3 which both included a clarification step, resulted in a white sugar having lower and, accordingly, superior colour values. The clarification step removes some colourants which affect the whiteness of the white sugar product.

The white sugar produced by process 2 is, however, surprisingly greatly superior to that produced by process 3 with the turbidity value of the white sugar of process 2 being approximately half that of the white sugar produced by process 3.

Process 2 also has the significant commercial advantage that the clarification step can be carried out in a sugar mill prior to the VLC sugar being transported to a sugar refinery. This provides an opportunity to dispose of the clarification waste at a lower cost and also provides an off-season use for sugar mills which otherwise typically lie idle and unproductive after the milling season.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

We claim:

1. A process for refining raw sugar comprising the steps of:

(a) dissolving either washed raw sugar or raw sugar directly to produce a melter liquor;

(b) clarifying the melter liquor;

(c) crystallising the melter liquor to produce a mixture of a very low colour intermediate sugar and a syrup;

(d) separating the very low colour intermediate sugar from the syrup;

(e) redissolving the separated very low colour intermediate sugar to produce a fine liquor;

(e) filtering the fine liquor to remove any foreign particles which may have contaminated the sugar produced in step (d); and (g) crystallising refined sugar from the fine liquor.

2. A refined sugar as produced by the process of claim 1.

3. A process for producing a very low colour intermediate sugar comprising the steps of:

(a) dissolving either washed raw sugar or raw sugar directly to produce a melter liquor;

(b) clarifying the melter liquor;

(c) crystallising the melter liquor to produce a mixture of a very low colour intermediate sugar and syrup; and (d) separating the very low colour intermediate sugar from the syrup.

4. A very low colour intermediate sugar as produced by the process of claim 3.

5. The process of claim 3 wherein steps a–d are undertaken in a sugar mill.

6. A refined sugar as produced by the process of claim 5.

7. The process of claim 5 further comprising the steps of:

(e) transporting the very low color intermediate sugar produced by steps a–d in a sugar mill to a sugar refinery;

(f) redissolving the transported very low color intermediate sugar to produce a fine liquor;

(g) filtering the fine liquor to remove any foreign particles which may have contaminated the sugar produced in step (d); and, (h) crystallising a refined sugar from the fine liquor.

8. The process of claim 1 or 3 wherein the step of clarifying the melter liquor is achieved by phosphatation or carbonatation.

9. The process of claim 1 or 3 wherein in step (d) the sugar is separated from the syrup by a centrifugal.

* * * * *